US007854635B1

(12) United States Patent
Duncan

(10) Patent No.: US 7,854,635 B1
(45) Date of Patent: Dec. 21, 2010

(54) ADAPTER FOR AIR CONDITIONING CONNECTOR

(76) Inventor: Charles Duncan, 1737 SE. Aires La., Port St. Lucie, FL (US) 34984

( * ) Notice: Subject to any disclaimer, the term of this patent is extended or adjusted under 35 U.S.C. 154(b) by 0 days.

(21) Appl. No.: 12/400,367

(22) Filed: Mar. 9, 2009

Related U.S. Application Data

(60) Provisional application No. 61/035,197, filed on Mar. 10, 2008.

(51) Int. Cl.
*H01R 11/09* (2006.01)

(52) U.S. Cl. ..... 439/787; 439/439

(58) Field of Classification Search ..... 439/439, 439/787, 790, 860; 174/87
See application file for complete search history.

(56) References Cited

U.S. PATENT DOCUMENTS 4,746,310 A * 5/1988 Morse et al. ..... 439/620.13
5,252,779 A * 10/1993 DiRienzo ..... 174/87
6,025,559 A * 2/2000 Simmons ..... 174/87
6,758,577 B2 * 7/2004 Wu ..... 362/647
6,878,880 B2 * 4/2005 King, Jr. ..... 174/87
7,182,614 B2 * 2/2007 Crestin ..... 439/188
7,614,922 B1 * 11/2009 Buse ..... 439/787

* cited by examiner

*Primary Examiner*—Thanh-Tam T Le
(74) *Attorney, Agent, or Firm*—Gold & Rizvi, P.A.; Glenn E. Gold; H. John Rizvi

(57) ABSTRACT

An electrical connectivity disc (100, 130, 200) includes a plurality of serrated slots (106, 108) positioned about the disc. The disc preferably includes a plurality of barbs (136) about a peripheral edge (104) of the disc (130). A center aperture (110) can be formed in a center of the disc (130). A portion of the serrated slots (108) can be located in communication with the center aperture (110). The discs (130) are inserted into a generally an electrically conductive, cylindrical tubular structure (160). A cable (190) is inserted into a receiving aperture (168) and crimped providing an electro-mechanical interface with the tubular structure (160). The cable (190) provides an electrical connection to an air conditioning power input terminal block.

14 Claims, 10 Drawing Sheets

ADAPTER FOR AIR CONDITIONING CONNECTOR

CROSS-REFERENCE TO RELATED APPLICATION

This Non-Provisional Utility application claims the benefit of co-pending U.S. Provisional Patent Application Ser. No. 61/035,197, filed on Mar. 10, 2008, which is incorporated herein in its entirety.

BACKGROUND OF THE INVENTION

1. Field of the Invention

The invention relates generally to electrical connection devices. More particularly, it relates to a disc member having a plurality of serrated slots extending through the disc for receiving and securing an electrical wire, whereby the disc is seated within and frictionally secured within a generally cylindrical tube of electrically conductive material.

2. Background of the Invention

The present invention relates to an electrical connection adapter for an air conditioning system, and more specifically, to an apparatus and method of connecting an electrical power conductor to an electrical drive motor of the air conditioning system.

Air conditioning systems generally comprise four key components: an evaporator, a condenser, a compressor, and a dryer. A typical installation locates the compressor and its associated motor on the outside of a building, where they are exposed to the environment. The compressor motor is commonly incorporated within a compressor and the entire compressor assembly is hermetically sealed, protecting the compressor assembly components from the environment. Several commonly known electrical connection form factors are utilized to provide electrical power to the compressor motor. A first such connection form factor is an electrical spade connection configuration. This is a well known configuration.

During servicing of an air conditioning system, it is common practice to separate the electrical connection at the compressor motor. It is not uncommon to find a corroded spade connection, which ultimately results in a broken spade. The service technician then needs to repair or replace the electrical connection. This can be a laborious and expensive process.

A second connection form factor is a generally cylindrical tubular structure utilizing a setscrew. A bare section of an electrical wire is inserted into a center of the tubular structure either via a slot along the length of the tubular structure or through an opening of the structure. The setscrew compresses the exposed wire to provide an electro-mechanical connection. The tubular structure is connected the motor via a metallic pin. The configuration of the setscrew makes an installation difficult to accomplish. Additionally, the setscrew is susceptible to being stripped when tightened.

Accordingly, it is desirable to provide a system and apparatus for enabling an electrical connection to a damaged or deteriorated electrical connector on an air conditioning compressor assembly.

SUMMARY OF THE INVENTION

In view of the limitations presented in the background herein, the present invention provides a novel design, which presents an electrical connection for repair of a damaged or deteriorated electrical connector on an air conditioning compressor assembly.

One aspect of the present invention is a metallic electrical connecting disc comprising a plurality of serrated shaped apertures or slots and an aperture for receiving a metallic coupling pin, wherein the disc is inserted into a metallic generally cylindrically shaped tubular structure.

Another aspect of the present invention incorporates a plurality of serrated shaped apertures or slots integrated about, and in communication with, the pin receiving aperture.

Yet another aspect provides a friction-increasing configuration integrated about a peripheral edge of the electrical connecting disc. The friction-increasing configuration can utilize at least one of: a ragged edge, a plurality of projections or barbs, tapered projections, and an "S" shaped stamping, for example.

Another aspect provides a formed electrical connecting disc having a generally conical shape.

A further aspect utilizes an electrically conductive material, such as beryllium copper, copper, brass, bronze, steel, zinc plated steel, stainless steel, aluminum (although less preferred), metallic plated plastics, and the like.

Another aspect of the present invention provides a connection interface between the cylindrically shaped tubular structure and the electrical input of an air conditioning compressor motor. The interface incorporates a receiving aperture into a distal end of the tubular structure, wherein a cable is inserted and electro-mechanically coupled via a crimping process, a brazing process, a soldering process, and the like. The opposing end of the cable incorporates a coupling member for interfacing with an existing air conditioning electrical connection.

Yet another aspect utilizes two or more of connections in accordance with the present invention, placing an insulating member between the two or more cylindrical structures.

The foregoing has outlined, in general, the physical aspects of the invention and is to serve as an aid in better understanding the more complete detailed description that is presented herein. In reference to such, there is to be a clear understanding that the present invention is not limited to the method or detail of construction, fabrication, material, or application of use described and illustrated herein. Any other variation of fabrication, use, or application should be considered apparent as an alternate embodiment of the present invention.

BRIEF DESCRIPTION OF THE DRAWINGS

A full and enabling disclosure of the present invention, including the best mode thereof, directed to one of ordinary skill in the art, is set forth more particularly in the remainder of the specification, which makes reference to the appended Figs., in which.

DETAILED DESCRIPTION OF REPRESENTATIVE EMBODIMENTS

Figure 1:
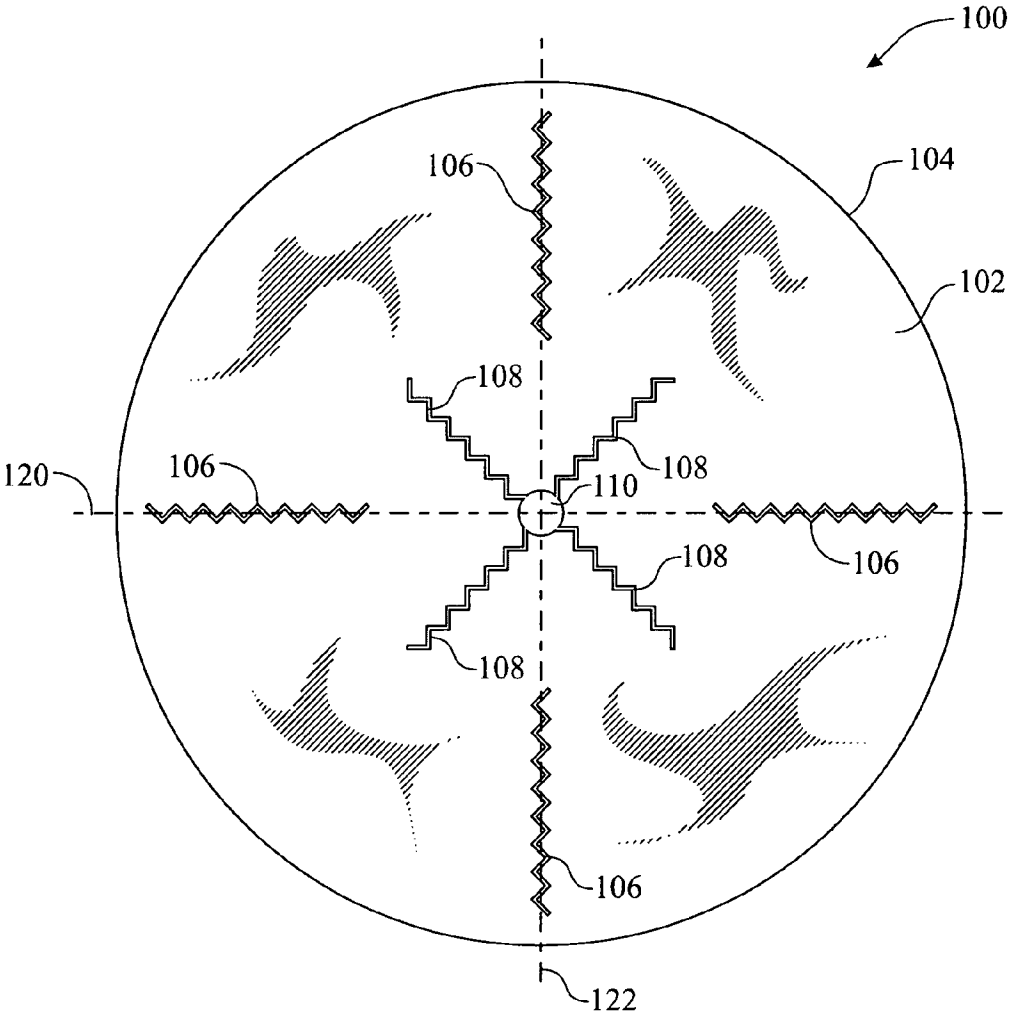
FIG. 1 presents a planar view of an exemplary embodiment of an electrical connectivity disc.

Referring initially to FIG. 1, an exemplary electrical connectivity disc is shown generally as reference numeral 100. The disc 100 has a generally circular shape disc main body 102 defined by a disc peripheral edge 104. The disc 102 can be constructed from any reasonably resilient and electrically conductive material, such as Copper, Beryllium Copper, Brass, Stainless Steel, Zinc plated Iron, plated plastics, and plated composites, to name just a few. The disc 102 is fabricated having a plurality of distal electrical receiving slots 106 and/or a plurality of central electrical receiving slots 108. A center aperture 110 can be incorporated in the center of the electrical connectivity disc 100, for coupling of another object, such as a second electrical connectivity disc 100, a cylindrical tubular structure (presented as 160 later herein), and the like. The illustration presents a lateral centerline axis 120 and a longitudinal centerline axis 122 as a reference for orientation. The electrical receiving slots 106, 108 can be located in any orientation respective to the lateral centerline axis 120 and the longitudinal centerline axis 122, wherein the exemplary embodiment illustrated orients the distal electrical receiving slots 106 aligned and parallel to each of the axes 120, 122 and in a direction towards the disc peripheral edge 104, and the central electrical receiving slots 108 are oriented proximate the center of the disc material 102 and oriented at a 45 degree angle respective to each of the axes 120, 122. The central electrical receiving slots 108 can additionally be contiguous with the center aperture 110. The electrical connectivity disc 100 can be fabricated via any known forming process, including stamping, machining, etching (chemical, laser, and the like), and any combination therein.

Figure 3:
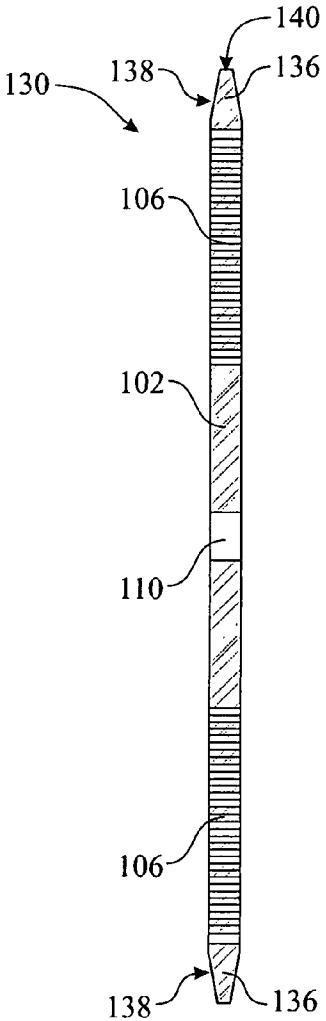
FIG. 3 presents a sectional view of the electrical connectivity disc taken along section 3-3 of FIG. 2.
Figure 2:
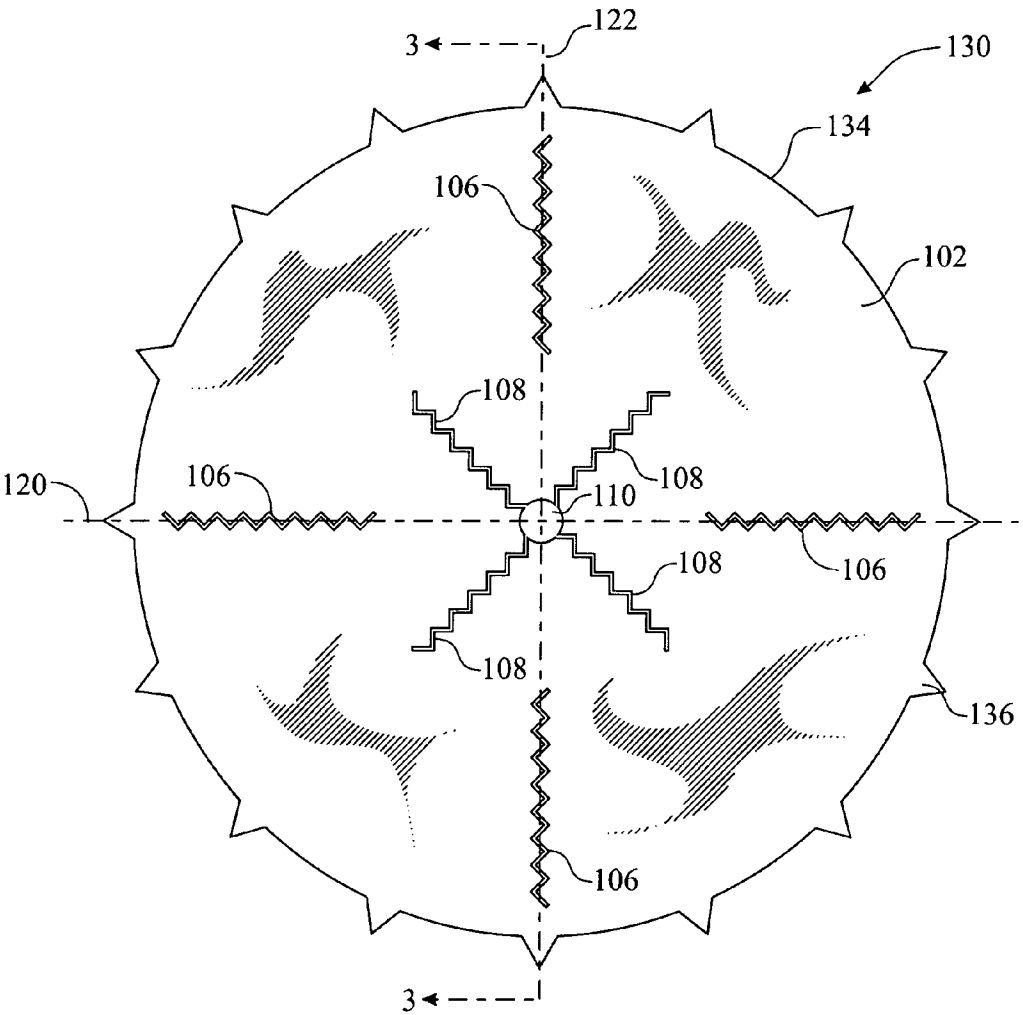
FIG. 2 presents a planar view of an enhanced version of the exemplary embodiment of an electrical connectivity disc.
Figure 4:
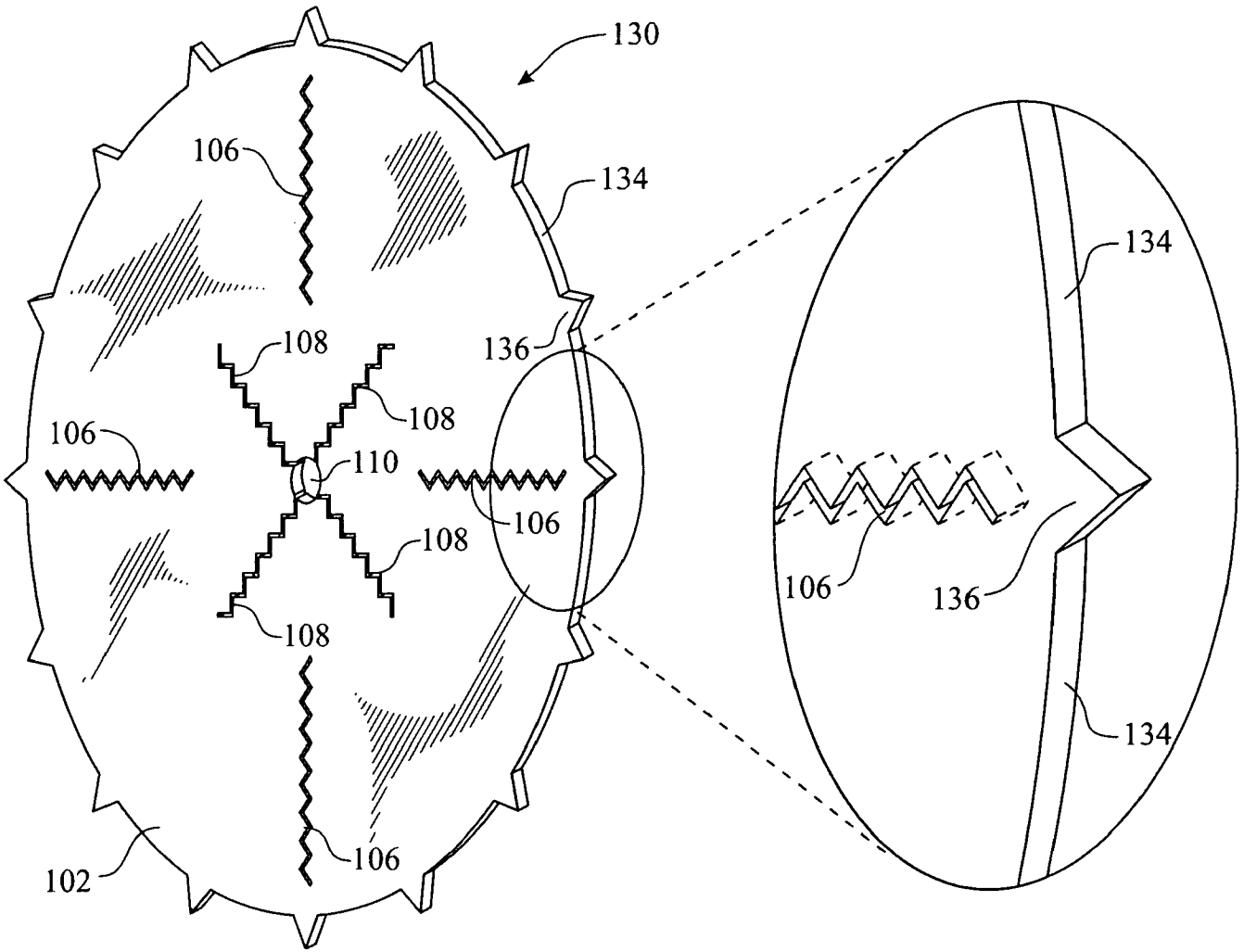
FIG. 4 presents an isometric frontal view of the enhanced version of the electrical connectivity disc presented in FIG. 2, including a magnified view of a friction enhancing feature and a serrated wire receiving slot.
Figure 5:
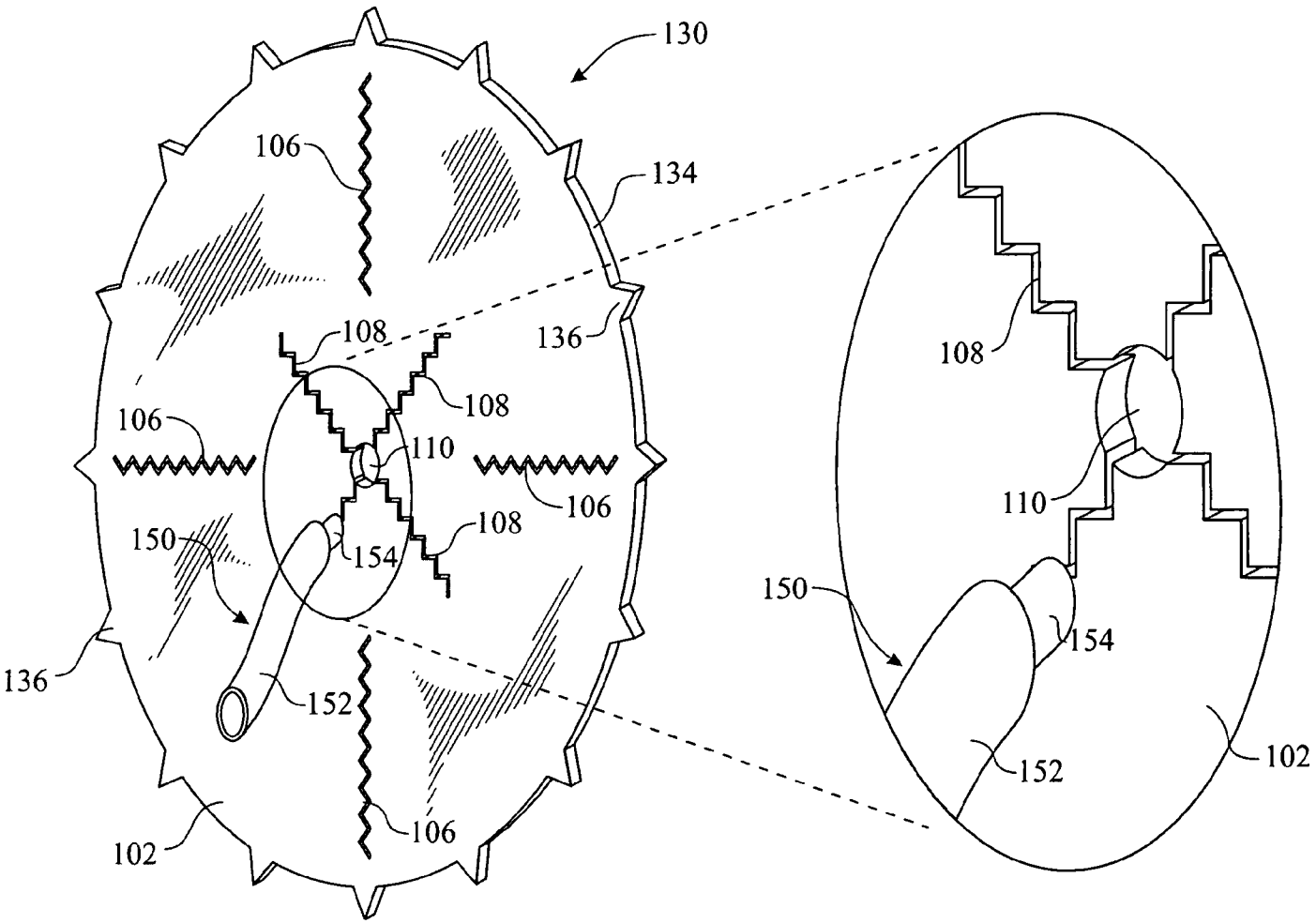
FIG. 5 presents an isometric frontal view of an electrical wire inserted into a wire receiving slot of the enhanced version of the electrical connectivity disc presented in FIG. 2, including a magnified view of an inserted section.

Referring to FIGS. 2 through 5, an enhanced exemplary electrical connectivity disc, introducing a plurality of barbs 136, is shown generally as reference numeral 130. A planar view is presented in FIG. 2. A sectional view taken along section 3-3 of FIG. 2 is illustrated in FIG. 3. An isometric view, including a magnified detail of the slot 106 and barbs 136, is presented in FIG. 4. Details presenting an electrical wire 150 inserted into the central electrical receiving slots 108 of the friction enhanced electrical connectivity disc 130 is presented in FIG. 5.

The friction enhanced electrical connectivity disc 130 incorporates the features of disc 100, and further introduces a friction increasing peripheral feature, such as a plurality of barbs 136 integrated about an enhanced friction edge 134 of the disc material 102. The barbs 136 can be of any reasonably engineered geometry, wherein the geometry provides an interference fit between the friction enhanced electrical connectivity disc 130 and a hollowed section (presented as 164 later herein) of the tubular structure. The preferred shape, as illustrated, is triangular, providing a sharp corner projecting from the enhanced friction edge 134 to provide an interference engagement with an inside wall of the hollowed section along a contacting interface 140. The interference engagement can be enhanced by forming a tapered edge 138 onto the edges of the barbs 136 as presented in FIG. 3. Other shapes can include rectangular, trapezoidal, circular, and the like. The enhanced friction edge 134 can alternately comprise an "S" shaped stamped edge to increase the friction of the edge interface. The friction enhanced electrical connectivity disc 130 can be fabricated in the same manner as previously described, with any additional forming processing respective to the enhanced friction edge 134, such as machining, stamping, etching, and the like. The discs 130 can be fabricated in strips or other carrier shape and singulated upon completion of the forming processes.

An electrical wire 150 is fabricated having a conductor 154 covered with wire insulation 152. The wire insulation 152 is removed from an end portion of the electrical wire 150 exposing the section of the conductor 154. The conductor 154 is then inserted through any of either of the distal electrical receiving slots 106 or the central electrical receiving slots 108. The serrated edges of the slots 106, 108 engage the conductor 154 providing both a mechanical and an electrical connection. It is recognized that although the illustration presents a "Z" or stair stepped shaped, any shape that can secure a wire into a slot can be utilized.

Figure 6:
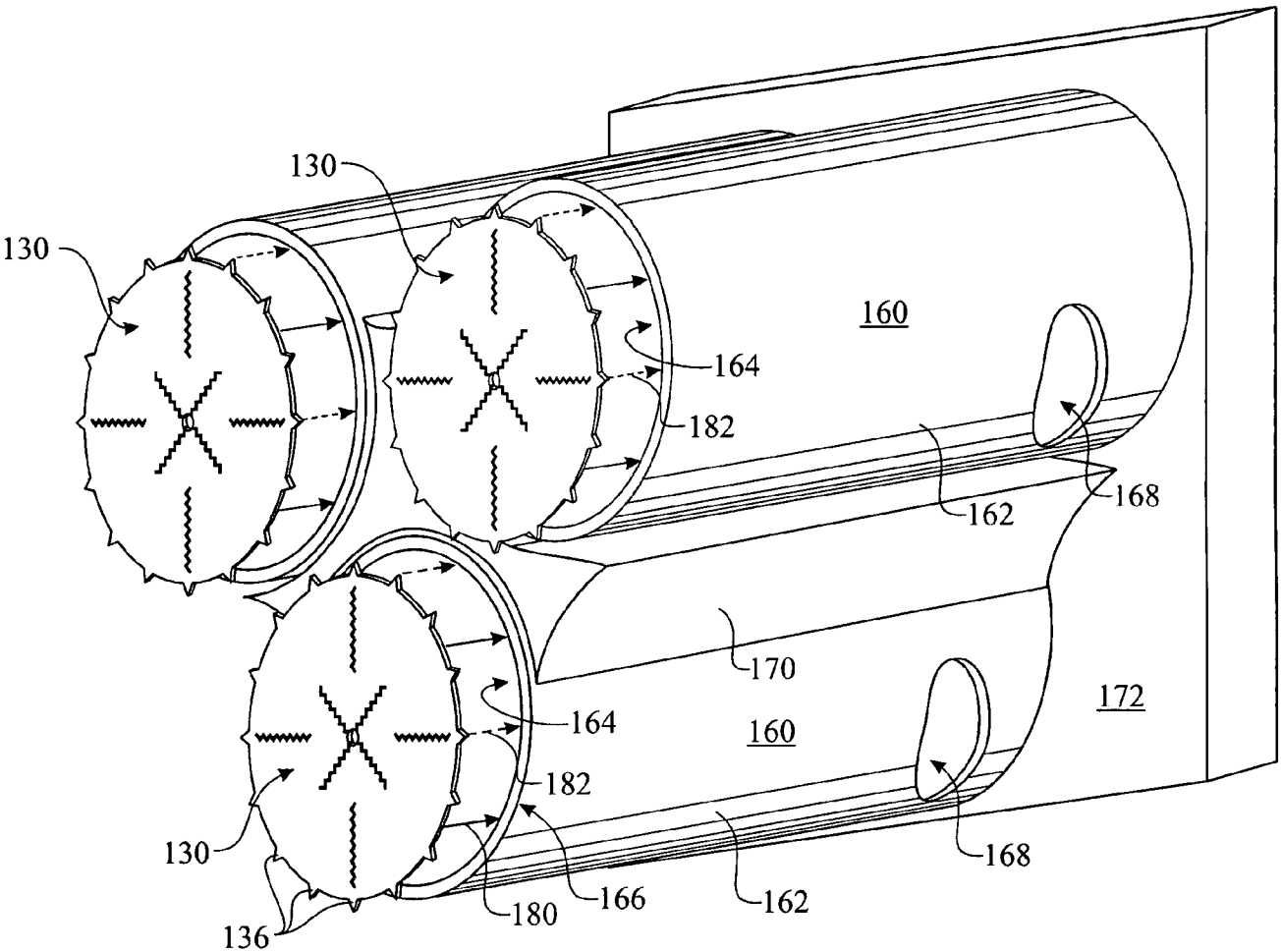
FIG. 6 presents an isometric view of the electrical connectivity discs being inserted into a plurality of electrically conductive, generally cylindrically shaped tubular structures.
Figure 7:
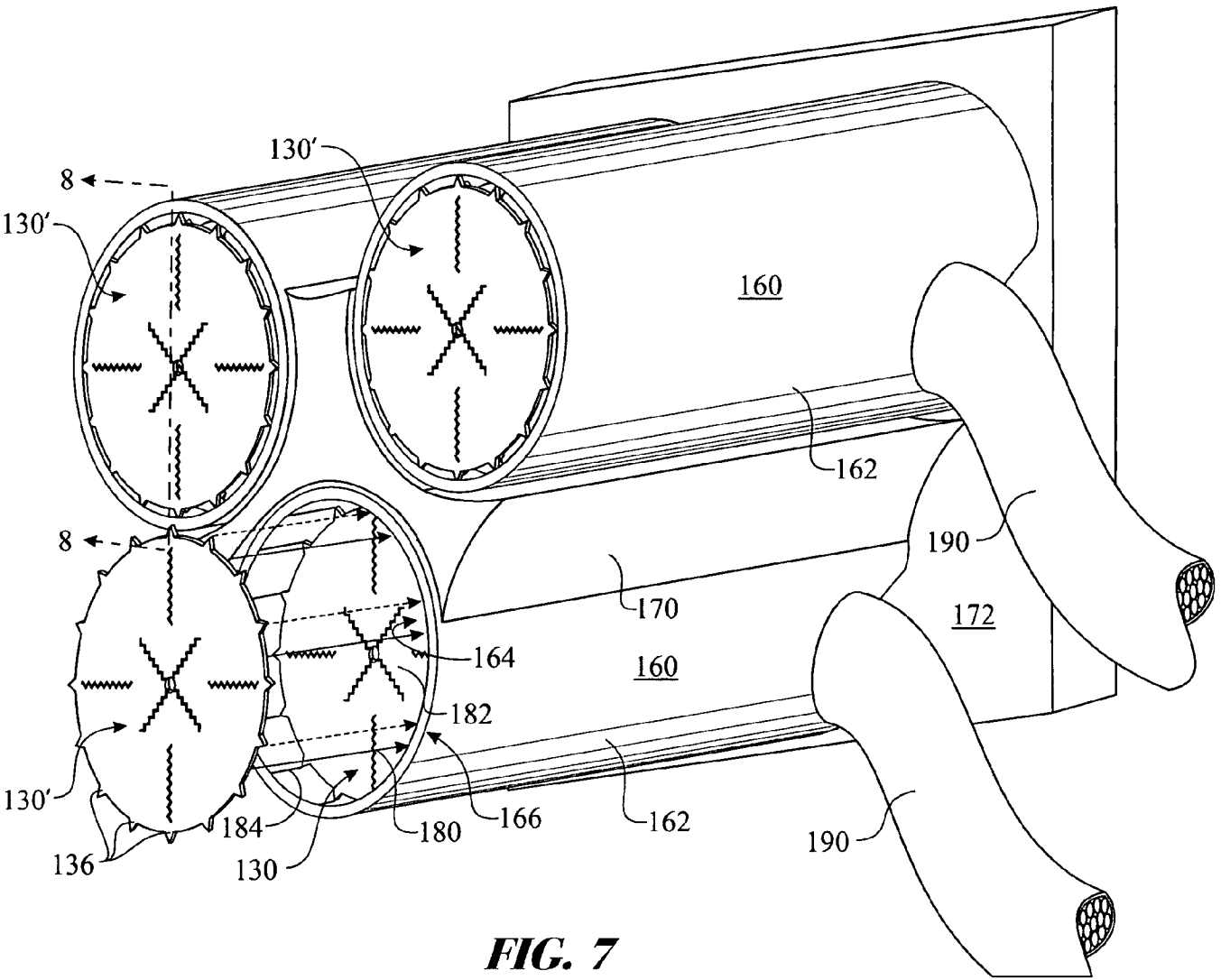
FIG. 7 presents an isometric view of the electrical connectivity discs as inserted into the plurality of electrically conductive, generally cylindrically shaped tubular structures.
Figure 8:
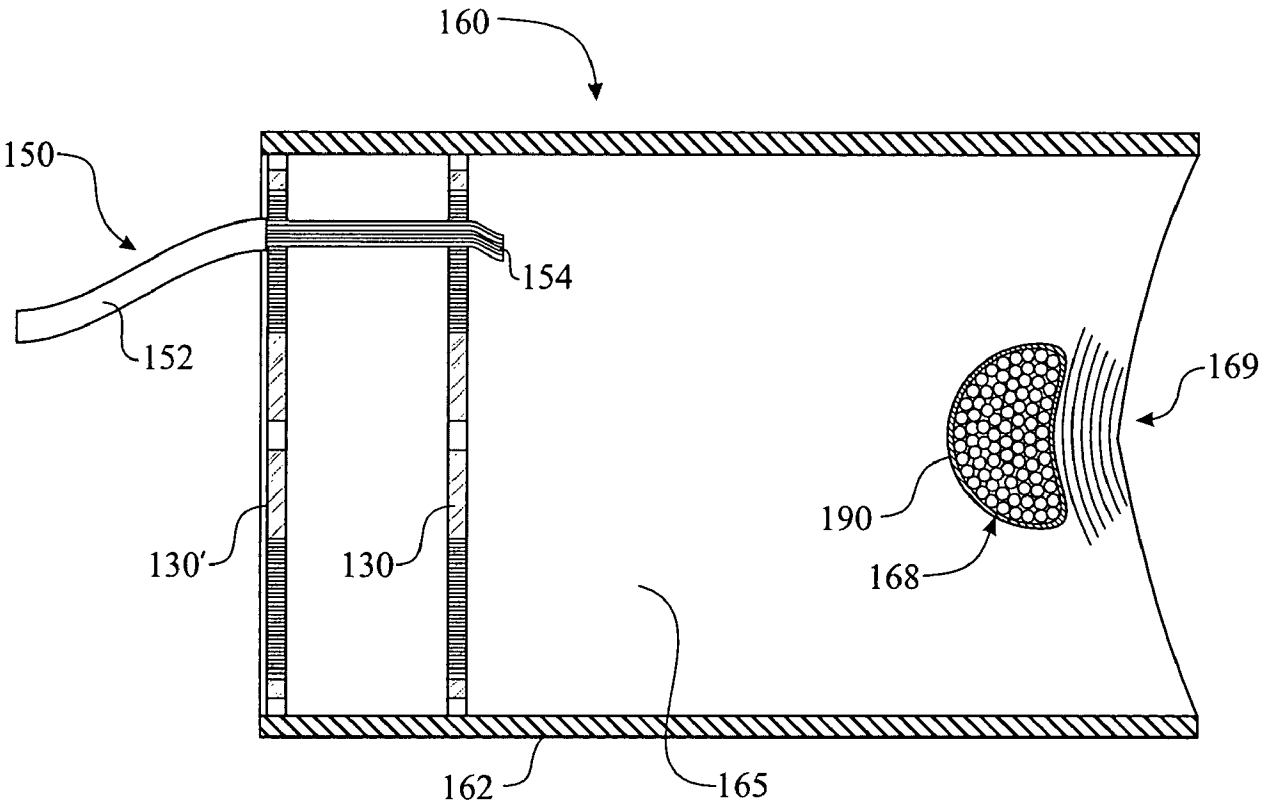
FIG. 8 presents a sectional elevation view of the electrical connectivity disc as inserted into the tubular structure, the view taken along section 8-8 of FIG. 7.
Figure 9:
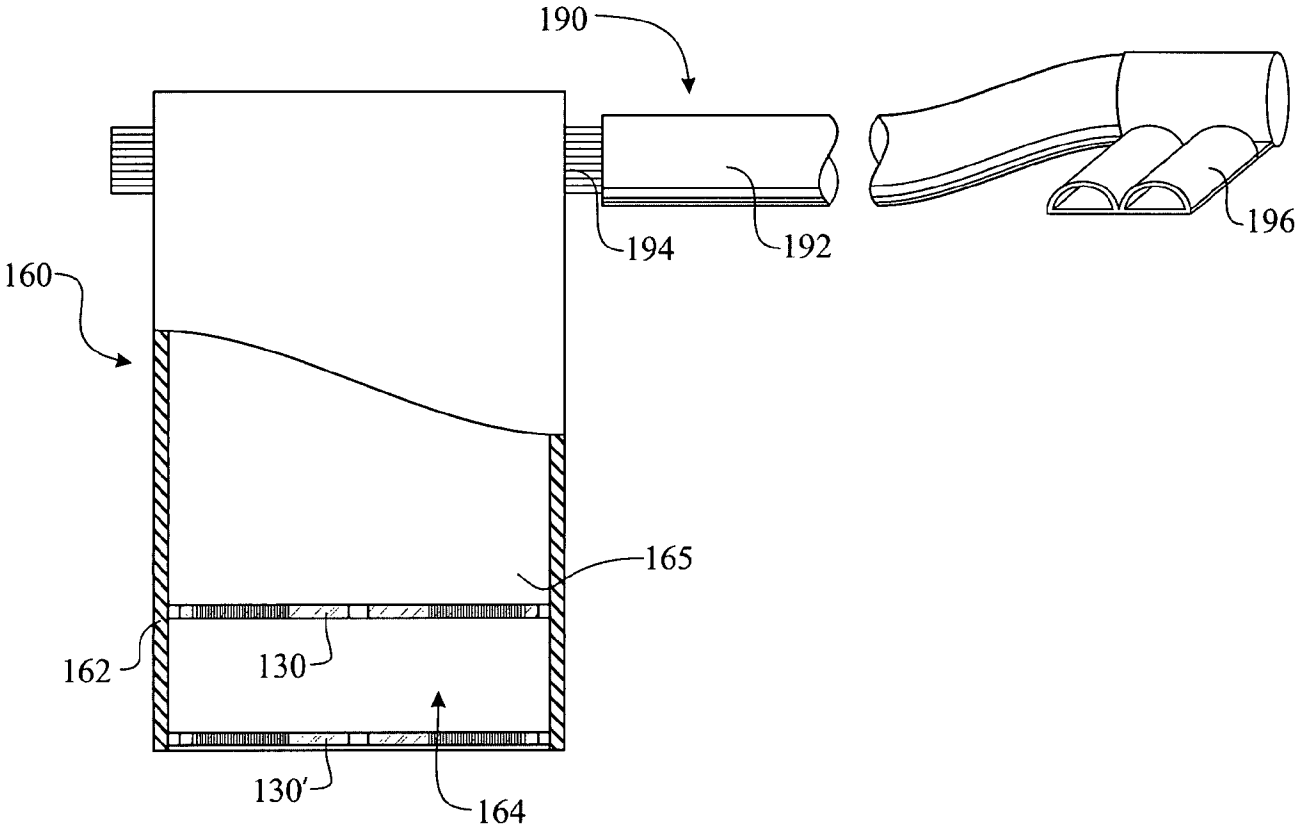
FIG. 9 presents a partially sectioned, planar view of the electrical connectivity disc as inserted into the tubular structure further illustrating an assembly of a cable.
Figure 10:
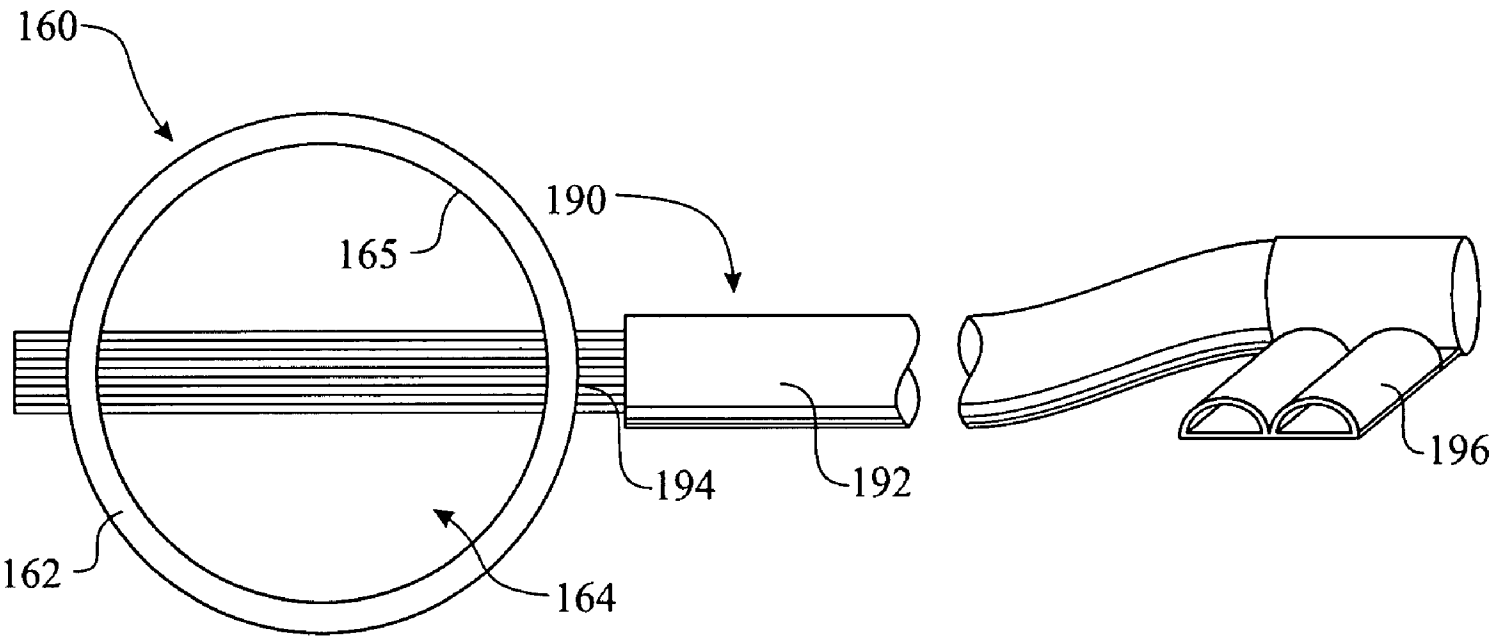
FIG. 10 presents a frontal view of the assembly of the cable into the tubular structure.

The electrical connectivity discs 100, 130 are installed into a tubular disc receiving member 160 providing the desired electro-mechanical interface to the air conditioning compressor. An exemplary assembly is presented in FIGS. 6 through 10. An insertion of the inner friction enhanced electrical connectivity disc 130 into the tubular disc receiving member 160 is presented in FIG. 6. The assembly of the outer friction enhanced electrical connectivity disc 130' as well as the introduction of the cable 190 is presented in FIG. 7. A sectional side view of the assembly is presented in FIG. 8, the sectioning taking along 8-8 of FIG. 7. A partially sectional top view of the assembly is presented in FIG. 9. An end view of the assembly is presented in FIG. 10.

The electrical adaptor includes a disc-receiving member 160 having a tubular geometry 162 which provides a hollowed section 164. In a preferred embodiment, two enhanced discs 130, 130' would be inserted via a disc insertion 180 into a hollowed section 164 of the tubular disc receiving member 160. The interference fit of the disc 130 causes the barbs 136 to forcibly engage an inner wall 165 of the tubular structure 162 via a barb engagement 182, which occurs during a disc insertion 180. As the disc 130 is inserted 180, the barbs 136 create engaging gouges 184. A second disc is inserted and preferably positioned proximate an insertion end 166 of the tubular structure 162. The electrical wire 150 could be inserted into both discs prior to insertion of, or after insertion of, the inner disc 130 forming a reliable connection as presented in FIG. 8. The tubular disc receiving member 160 includes a cable receiving aperture 168 located proximate a distal end of the tubular disc receiving member 160. A section of cable insulation 192 proximate an end of a cable 190 is removed, exposing a short section of electrically conductive cable material 194. The electrically conductive material 194 is inserted through the cable receiving aperture 168 of the tubular disc receiving member 160. The cable electrically conductive material 194 is then secured by crimping the end of the tubular disc receiving member 160 to form a cable connecting crimp 169. Alternatively, the cable can be secured via a soldering, brazing or other process. The cable 190 can include a terminal connector 196 on the distal end, the terminal connector 196 providing an interface with the air conditioning compressor power input. A plurality of tubular members 160 can be grouped together providing electrical conductivity to each of the three required connections: Positive, Negative, and Ground. An insulating material 170 is positioned between each of the plurality of tubular disc receiving members 160, providing electrical isolation between them. The plurality of tubular disc receiving member 160 can be assembled to an optional configuration member 172, ensuring the physical configuration remains consistent.

Figure 12:
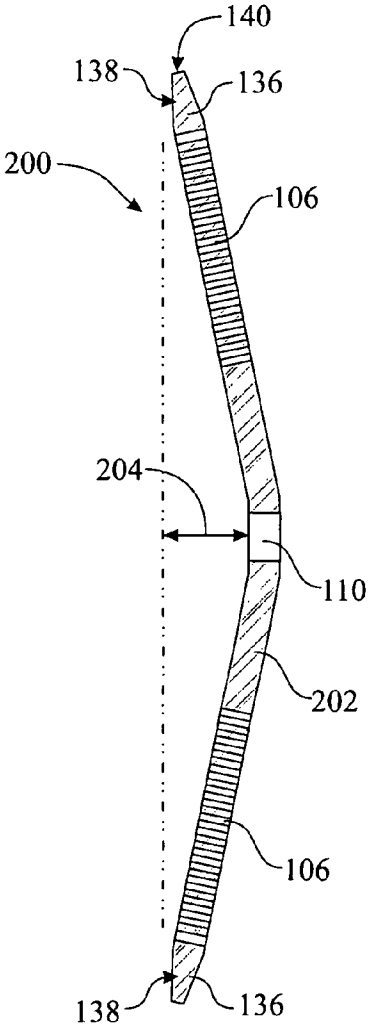
FIG. 12 presents a sectional elevation view of the exemplary illustration of a conically shaped electrical connectivity disc, the view taken along section 12-12 of FIG. 11.
Figure 11:
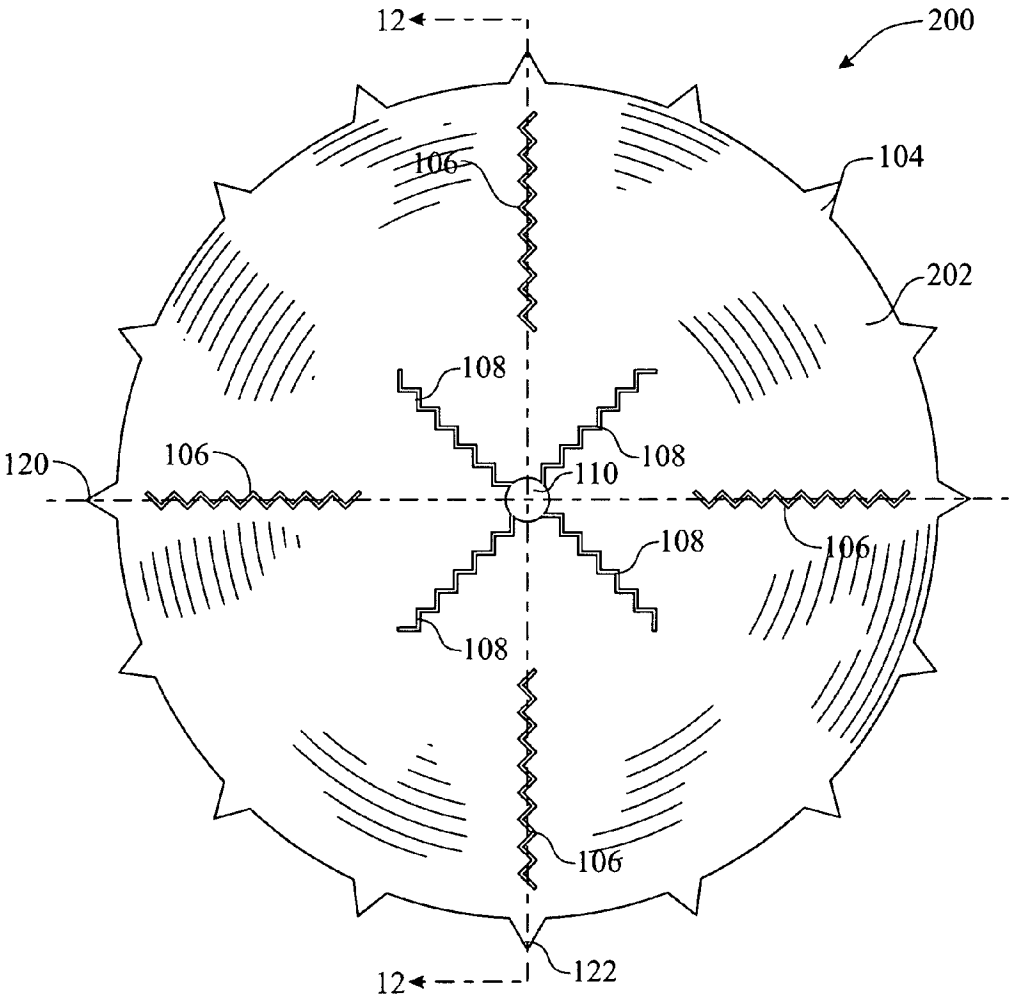
FIG. 11 presents a planar view of an exemplary illustration of a conically shaped electrical connectivity disc.

Referring to FIGS. 11 and 12, a conically shaped electrical connectivity disc is shown generally as reference numeral 200. A planar view is presented in FIG. 11. A sectional view taken along section 12-12 of FIG. 11 is illustrated in FIG. 12.

The conically shaped electrical connectivity disc 200 is fabricated having a cone shaped disc material 202, which incorporates the features of friction enhanced electrical connectivity disc 130, but formed into a conical shape. The conical shape displaces the center of the cone shaped disc material 202 from the edge of the cone shaped disc material 202 via a center displacement 204. The disc 200 would be fabricated by stamping the features from a raw sheet of material, maintaining the stamping in a carrier strip, then inserting the carrier strip into a forming press and forming the planar material into a conical shape. The forming press is sometime referred to as a drawing process. The material can be hardened if desired, to increase the spring rate of the material.

While the preferred embodiments of the invention have been illustrated and described, it will be clear that the invention is not so limited. Numerous modifications, changes, variations, substitutions and equivalents will occur to those skilled in the art without departing from the spirit and scope of the present invention as described in the claims.

What is claimed is:

1. An electrical interface, comprising:

an electrical connectivity disc formed from an electrically conductive material, having a plurality of spaced serrated slots extending through a disc body;

a generally cylindrical shaped tubular structure constructed from an electrically conductive material, the electrical connectivity disc inserted into and frictionally seated within the tubular structure and a center aperture located proximate a center of the disc;

wherein at least a portion of each of the plurality of serrated slots are in communication with the center aperture.

2. An electrical interface as recited in claim 1, further comprising:

an electrical interface between the cylindrically shaped tubular structure and an air conditioning power input.

3. An electrical interface as recited in claim 1, further comprising a plurality of barbs located about a peripheral edge of the disc.

4. An electrical interface as recited in claim 1, comprising a plurality of generally cylindrical shaped tubular structures assembled together having an electrically insulation provided therebetween.

5. An electrical interface, comprising:

an electrical connectivity disc formed from an electrically conductive material, having a plurality of spaced serrated slots extending through a disc body; and a generally cylindrical shaped tubular structure constructed from an electrically conductive material, the electrical connectivity disc inserted into and frictionally seated within the tubular structure;

a cable receiving aperture extending through said generally cylindrical shaped tubular structure located proximate an end of the tubular structure and a center aperture located proximate a center of the disc;

wherein at least a portion of each of the plurality of serrated slots are in communication with the center aperture.

6. An electrical interface as recited in claim 5, further comprising:

an electrical interface between the cylindrically shaped tubular structure and an air conditioning power input.

7. An electrical interface as recited in claim 5, further comprising a plurality of barbs located about a peripheral edge of the disc.

8. An electrical interface as recited in claim 5, comprising a plurality of generally cylindrical shaped tubular structures assembled together having an electrically insulation provided therebetween.

9. An electrical interface as recited in claim 5, further comprising an electrically conductive cable inserted through said cable receiving aperture, wherein the electrically conductive cable is secured via crimping a sidewall section of said cylindrical shaped tubular structure located between said cable receiving aperture and said proximate end of said cylindrical shaped tubular structure.

10. An electrical interface, comprising:

a first electrical connectivity disc, formed from an electrically conductive material, having a plurality of spaced serrated slots extending through a disc body;

a second electrical connectivity disc, formed from an electrically conductive material, having a plurality of spaced serrated slots extending through a disc body; and a generally cylindrical shaped tubular structure constructed from an electrically conductive material, the first electrical connectivity disc inserted into and frictionally seated within the tubular structure, and the second electrical connectivity disc inserted into and frictionally seated proximate an insertion end of the tubular structure and a center aperture located proximate a center of the disc;

wherein at least a portion of each of the plurality of serrated slots are in communication with the center aperture.

11. An electrical interface as recited in claim 10, further comprising:

an electrical interface between the cylindrically shaped tubular structure and an air conditioning power input.

12. An electrical interface as recited in claim 10, further comprising a plurality of barbs located about a peripheral edge of each disc.

13. An electrical interface as recited in claim 10, further comprising a cable receiving aperture extending through said generally cylindrical shaped tubular structure located proximate an end of the tubular structure.

14. An electrical interface as recited in claim 13, comprising a plurality of generally cylindrical shaped tubular structures assembled together having an electrically insulation provided therebetween.

* * * * *